United States Patent [19]

Bokon

[11] Patent Number: 4,632,017

[45] Date of Patent: Dec. 30, 1986

[54] ENGINE

[76] Inventor: William S. Bokon, 6111 Geremander Ave., Rialto, Calif. 92376

[21] Appl. No.: 633,456

[22] Filed: Jul. 24, 1984

Related U.S. Application Data

[63] Continuation of Ser. No. 419,349, Sep. 7, 1982, abandoned, which is a continuation-in-part of Ser. No. 188,826, Sep. 19, 1980, abandoned, which is a continuation of Ser. No. 945,683, Sep. 25, 1978, abandoned.

[51] Int. Cl.[4] ..... F01B 1/06

[52] U.S. Cl. ..... 91/481; 91/496

[58] Field of Search ..... 123/55 AA, 61 V; 91/496, 180, 481, 493

[56] References Cited

U.S. PATENT DOCUMENTS

| | | | |
|---|---|---|---|
| 780,640 | 1/1905 | Conway | 91/493 |
| 894,682 | 7/1908 | Munden | 123/61 V |
| 897,260 | 8/1908 | Luther | 123/44 E |
| 1,212,100 | 1/1917 | Oldham | 123/44 E |
| 1,445,474 | 2/1923 | Benson et al. | 123/55 AA |
| 1,452,572 | 4/1923 | Prosser | 91/493 |
| 1,613,528 | 1/1927 | Palmer | 123/44 E |
| 1,735,764 | 11/1929 | Johnson | 123/55 AA |
| 1,748,443 | 2/1930 | Dawson | 123/55 AA |
| 3,572,209 | 3/1971 | Aldridge et al. | 123/55 AA |
| 4,106,391 | 8/1978 | Wheeler | 91/481 |

FOREIGN PATENT DOCUMENTS

| | | | |
|---|---|---|---|
| 707239 | 7/1931 | France | 123/55 AA |
| 961284 | 5/1950 | France | 123/55 AA |
| 12336 | of 1910 | United Kingdom | 123/55 AA |
| 11763 | of 1912 | United Kingdom | 91/205 |

*Primary Examiner*—Carlton R. Croyle
*Assistant Examiner*—Paul F. Neils
*Attorney, Agent, or Firm*—John H. Crowe

[57] ABSTRACT

An external combustion engine wherein a plurality of radially disposed piston cylinders are arranged around the axis of an output drive shaft. Pistons are reciprocal in the cylinders and actuate rollers carried by radially extending slide bearings, the rollers engaging in an eccentric cam groove formed in a flywheel fixed to the drive shaft. The cylinders have closed inner and outer ends and are provided with valve means for applying pressurized gas to opposite ends of the pistons at different times in a manner to provide power to a majority of the pistons at all times during rotation of the drive shaft. The engine can alternatively operate as a pump by applying motive power to the shaft.

1 Claim, 13 Drawing Figures

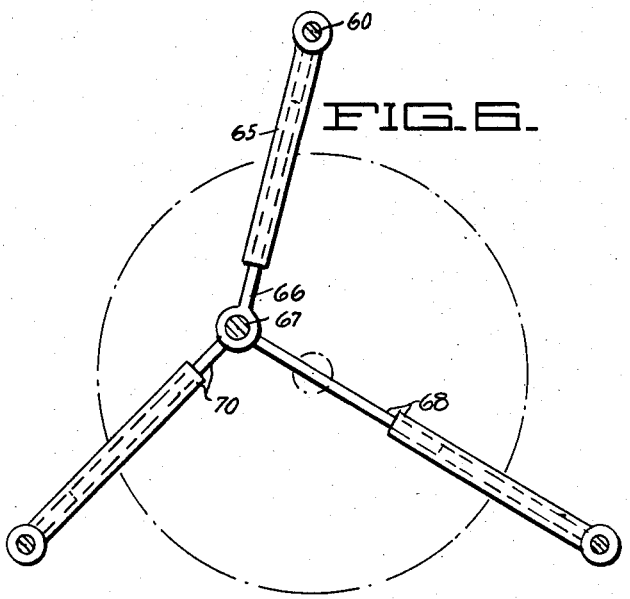
FIG. 6.
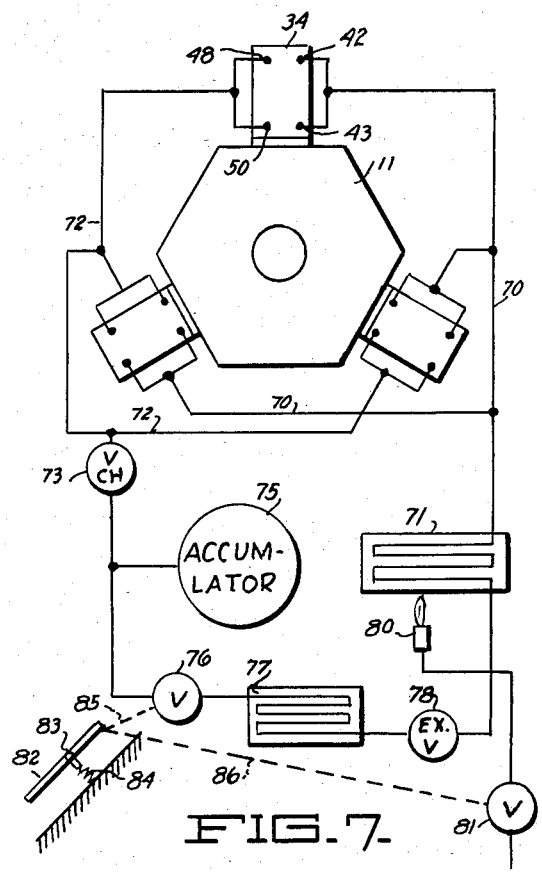
FIG. 7.
FIG. 8.
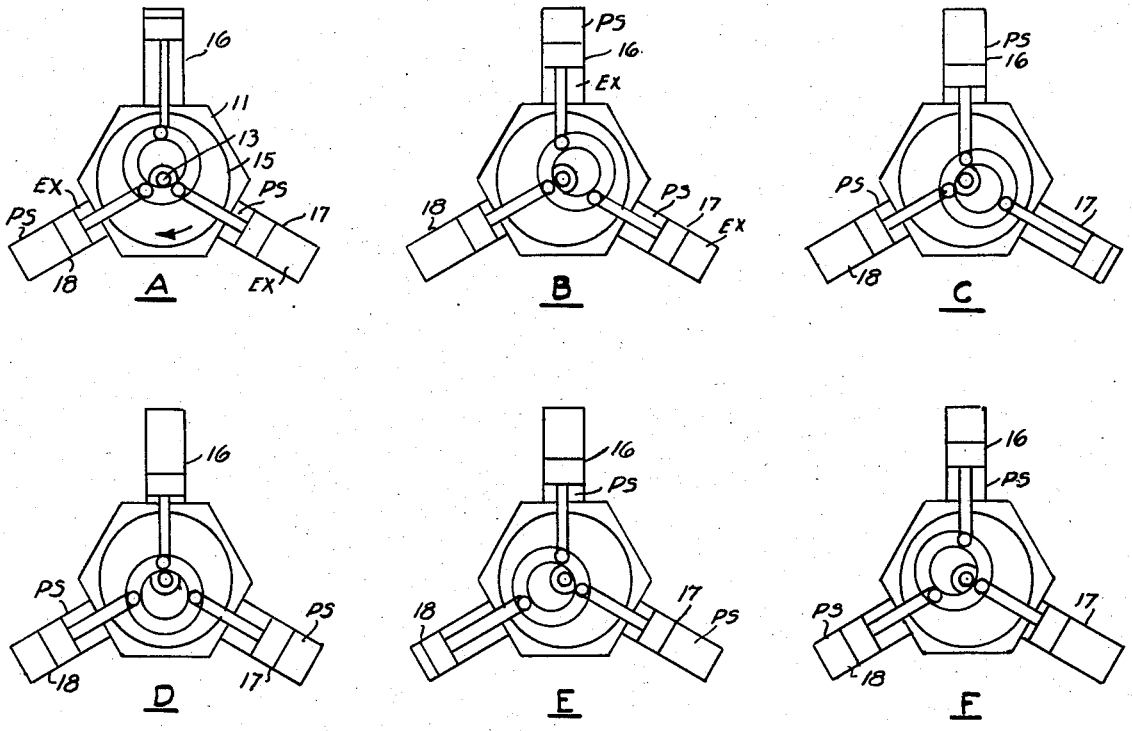

ENGINE

CROSS REFERENCE TO RELATED APPLICATIONS

This application is a continuation of my copending U.S. Application Ser. No. 06/419,349, filed Sept. 7, 1982, now abandoned, which is a continuation-in-part of my U.S. Application Ser. No. 06/188,826, filed Sept. 19, 1980, now abandoned, which was, in turn, a continuation of my U.S. Application Ser. No. 05/945,683, filed Sept. 25, 1978, now abandoned.

BACKGROUND OF THE INVENTION

1. Field of the Invention

This invention relates to energy translating devices and has particular reference to combustion engines for driving vehicles, such as automobiles, boats, aircraft, etc., as well as stationary machinery, such as power generating plants and the like.

2. Description of the Prior Art

Heretofore, internal combustion engines embodying pistons, a crankshaft and connecting rods pivotally connected between the pistons and the crankshaft, have been most commonly used to drive both vehicles and stationary machinery. Although such engines are generally satisfactory they present certain inherent drawbacks. Primarily, they must be operated at a relatively high speed to develop necessary power to operate a vehicle and therefore they require a relatively complicated and expensive variable speed transmission and clutch mechanism to accelerate the vehicle to a desired driving speed and to drive the vehicle at different speeds. Since internal combustion engines are driven by means of timed explosions within the cylinders and because such engines incorporate a crankshaft whereby power is transferred to the shaft at an uneven rate depending on the harmonic motion resulting from pressure of the piston connecting rods against the offset cranks, uneven power impulses are applied to the drive shaft, resulting in inefficient transfer of energy. Additionally, much of the energy is absorbed by virtue of friction within the variable speed transmission and associated mechanism.

Further, in a four stroke cycle internal combustion engine, only one power stroke occurs during each four strokes or two revolutions of the crankshaft, requiring a relatively large number of cylinders to obtain a substantially smooth application of power. This results in relatively heavy and expensive engines. Also, when the fuel-air mixture of an internal combustion engine is compressed and ignited in contact with the hot metallic elements of the cylinders and other components, such metallic surfaces act catalytically to generate nitrous oxides and other undesirable air pollutants, commonly known as smog.

SUMMARY OF THE INVENTION

A principal object of the present invention is to provide an engine having a relatively high efficiency.

Another object is to provide an engine having a relatively high torque at all speeds whereby to eliminate the need for a variable speed output transmission when used to propel a vehicle or the like.

Another object is to provide a lightweight, compact and yet smoothly operating engine.

Another object is to provide a combustion type engine which greatly reduces the generation of nitrous oxides and other air pollutants.

A further object is to provide a combustion type engine in which any type of combustible fuel may be used to convert heat into mechanical energy.

A further object is to provide an engine which can alternatively be used as a fluid pump.

A further object is to provide a combustion type engine for a vehicle in which the engine can be selectively utilized to effect regenerative braking.

According to the present invention, a radial external combustion engine is provided which utilizes a transfer or drive fluid, preferably incorporated in a closed loop system, for driving pistons operating in a plurality of radially extending cylinders spaced around the engine drive shaft. Such pistons operate drive rollers which are guided radially toward the drive shaft and which operate in a cam way formed in an output drive member fixed to the drive shaft. The drive fluid, preferably in the form of a gas, is applied under substantially constant pressure at different times to opposite sides of the various pistons in such a manner that power is continuously and concurrently applied to all but one cylinder at all times, thereby resulting in a constant application of relatively high torque at all speeds. This enables the engine to be attached directly to a vehicle drive wheel and thus eliminates the need for the usual variable speed transmission, differential and associated mechanisms. During operation, fuel is burned continuously at substantially atmospheric pressure and at a relatively low constant temperature which can be controlled to reduce the generation of air pollutants. Also, since no octane requirements are present, tetraethyl lead and similar additives are not required and a wide range of different fuels can be used.

In its preferred form, the engine, when used to propel a vehicle, is provided with a manually operable control pedal which actuates both a first valve in the fuel system to regulate the flow of fuel to a gas generator and a second valve which enables the engine to operate as a pump when braking the vehicle so as to pump the drive fluid, in gaseous form, into an accumulator where it is stored under pressure. Subsequently, upon manipulation of the control member, the pressurized drive fluid is released to drive the engine.

Although various volatile transfer drive fluids may be used, it is preferred to utilize perhalogenated benzene which has a low flamability characteristic, minimum corrosive properties and a low freezing point. Lubricating oil is preferably incorporated in the drive fluid and since such fluid is not subjected to extremely high temperature the oil need not be changed or replenished over long periods of time.

BRIEF DESCRIPTION OF THE DRAWINGS

The manner in which the above and other objects of the invention are accomplished will be readily understood on reference to the following specification when read in conjunction with the accompanying drawings wherein:

FIG. 6 is a sectional view through the valve operating linkage and is taken along the line 6—6 of FIG. 2.

FIG. 7 is a schematic view illustrating the closed loop drive fluid system and controls therefore.

FIG. 8 is a schematic view illustrating the various phases of operation of the engine during each revolution.

DESCRIPTION OF THE PREFERRED EMBODIMENT

Figure 5:
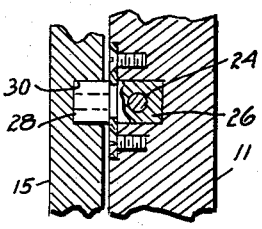
FIG. 5 is a fragmentary sectional view taken along the line 5—5 of FIG. 2.

Referring to the drawings, the engine of the present invention comprises a hexagonally shaped engine block 11 having a centrally located set of coaxially aligned bearings 12 for rotatably supporting a drive shaft 13. A combined fly wheel and cam disc 15 is keyed on the shaft 13 and is located closely adjacent the left side of the engine block 11 as viewed in FIG. 2. three equiangularly spaced cylinders 16, 17 and 18 are attached by bolts 20 to the block 11 with their axes extending radially outward from the shaft 13. Cylinder caps 21 are also attached to the cylinders by bolts 20 to hermetically seal the outer ends of the cylinders. Pistons 22 having piston rings 23 therearound are slideably fitted within the cylinders 16, 17 and 18 and are integrally attached to relatively small diameter connecting rods 24. The latter are threadably attached at 25 to slides 26 slideably mounted in radially extending guide ways 27 formed in the engine block 11. A roller 28 (see also FIG. 5) is rotatably supported by each slide 26 and fits within a cam groove 30 formed in the flywheel 15. The groove 30 is cylindrical in shape but formed eccentrically of the shaft 13.

Alternatively, the cam groove 30 could be formed oval shaped and arranged symmetrically about the shaft 13.

The inner end of each of the cylinders 16 and 18 is closed by a plate 31 which is secured in a counterbored section formed in the base of the cylinder and has a bearing opening surrounding the respective connecting rod 24. A sliding seal 32 hermetically seals the inner end of the cylinder around the connecting rod 24.

Figure 2:
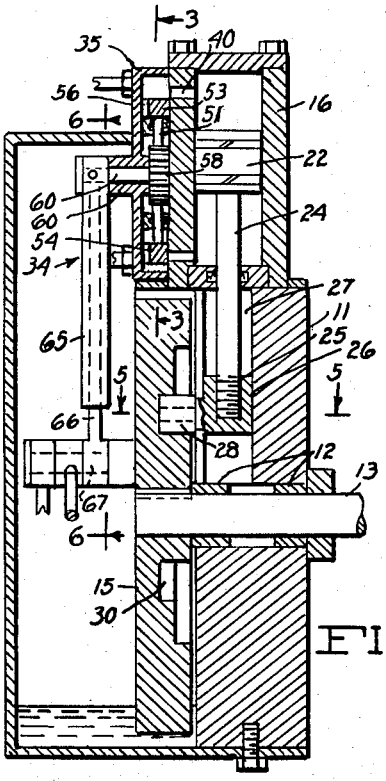
FIG. 2 is a transverse sectional view taken along the line 2—2 of FIG. 1.
Figure 4:
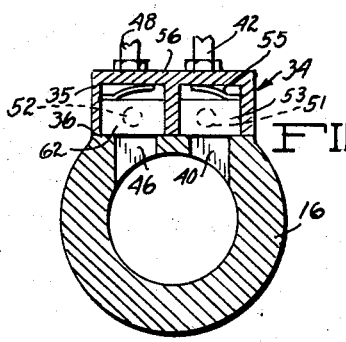
FIG. 4 is a sectional plan view taken along the line 4—4 of FIG. 3.
Figure 3:
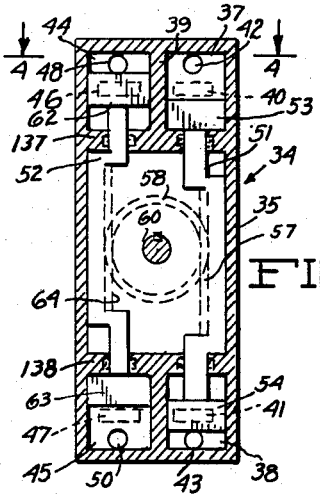
FIG. 3 is a sectional view through the valve mechanism for a typical cylinder and is taken along the line 3—3 of FIG. 2.

Valve means are provided to control the intake of pressurized gas into either end of each cylinder and to exhaust the opposite end of such cylinders in proper timed relation. for this purpose, a valve mechanism generally indicated at 34, FIGS. 2, 3 and 4, is provided for each of the cylinders. Such mechanisam is embodied in a casing 35 suitably secured to a flattened face 36 formed on the respective cylinder, the casing being partitioned into two separate spaced intake chambers 37 and 38 by walls 137 and 138 and each chamber being further divided by a wall 39 forming a right hand intake chamber section and a left hand exhaust chamber section (FIG. 3). The right hand section of chamber 37 and the right hand section of chamber 38 communicate with the outer and inner ends of the respective cylinder through slotted intake ports indicated by the dot-dash lines 40 and 41, respectively, in FIG. 3, and also with respective intake conduits 42 and 43. Likewise, the left hand exhaust sections of chambers 37 and 38 communicate with the inner and outer ends of the cylinder through slotted exhaust ports 46 and 47 and with exhaust conduits 48 and 50, respectively. Slide valves 51 and 52 are slidably mounted within the casing 35 and are yieldably held against the face 36 of the cylinder for controlling the flow of gas to and from the cylinders. The valve 51 carries valve heads 53 and 54 at opposite ends thereof which are located within the right hand intake sections of chambers 37 and 38 and are yieldably held in sealing engagement with the face 36 of the cylinder by spring fingers 55 which slideably engage the outer wall 56 of the casing 35. The valve 51 is slideable endwise to concurrently cover one of the ports 40 and 41 and uncover the other. Valve 51 has a rack gear 57 formed thereon and meshing with a drive gear 58 fixed on a rocking shaft 60 which is journalled in a bearing 61 formed in the wall 56 of the valve casing 35.

The valve 52 likewise carries a pair of valve heads 62 and 63 at opposite ends thereof which operate within the left hand exhaust sections of chambers 37 and 38 to open and close the exhaust ports 46 and 47. Valve 52 is provided with a rack gear 64 whcih meshes with gear 58 on the side thereof opposite the rach gear 57. Thus, rocking of the gear 58 shifts the valves 51 and 52 endwise in opposite directions to open certain of the ports and close others.

In the position of the parts shown in FIGS. 3, the valve 51 uncovers intake port 40 and covers intake port 41 while the valve 52 covers exhaust port 46 and uncovers exhaust port 47. However, when the gear 58 is rocked counterclockwise, the valve 51 will uncover port 41 and cover port 40 while valve 52 will cover port 47 and uncover port 46.

Means are provided for operating the various valve mechanisms, i.e. 34, for the various cylinders in timed relation to rotation of the drive shaft 13 and movement of the pistons 22 in their respective cylinders. For this purpose, a hollow rod 65 (FIGS. 2 and 6) is fastened at its upper end to the gear shaft 60 for the valve mechanism 34 associated with cylinder 16 and is slideably telescoped over a rod 66 having a bearing at its lower end journalled over a crank pin 67 extending from the flywheel 15, eccentrically of the shaft 13. Likewise, other telescoping pairs 68 and 70 of rods are connected between the crank pin 67 and the gear shafts for the valve mechanisms associated with the cylinders 17 and 18. Thus, as the flywheel 15 is rotated, the crank pin 67 imparts rocking motion to the various drive gears, i.e. 58, to shift the valves, i.e. 51 and 52, for the different cylinders between their alternate valve port covering and uncovering positions.

Figure 1:
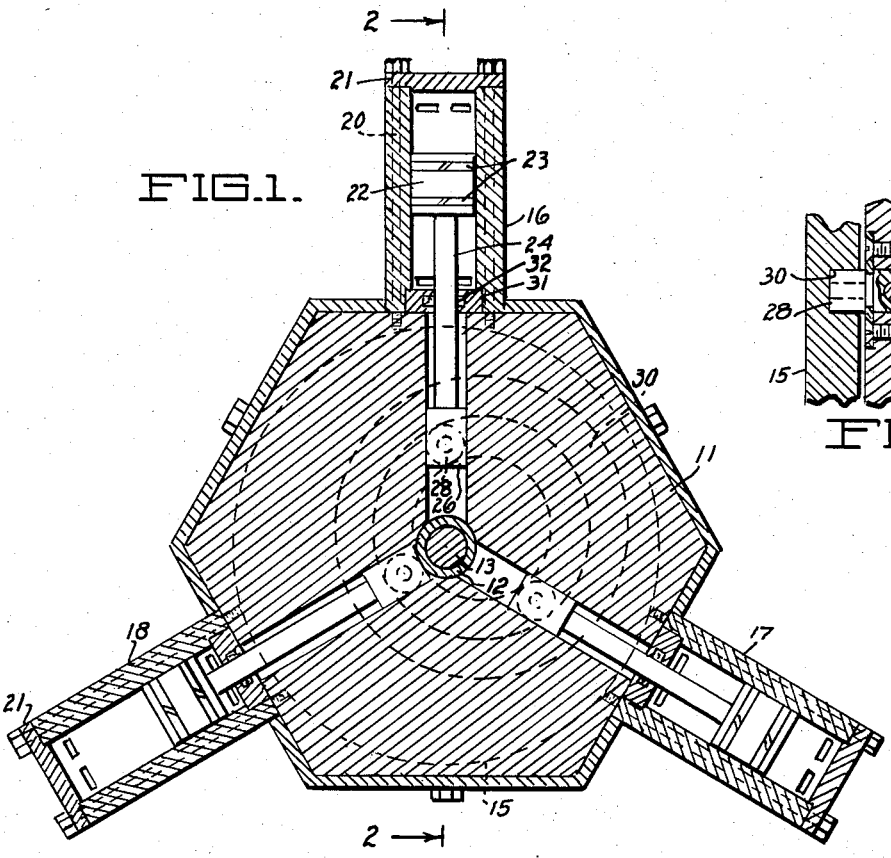
FIG. 1 is a sectional elevation view taken through an external combustion engine embodying a preferred form of the present engine.

FIG. 8 illustrates schematically the conditions which exist at each 60° increment of rotation of the drive shaft 13 and flywheel 15. It will be seen that a powr stroke "PS" is applied concurrently to the pistons of at least two of the three cylinders 16, 17 and 18 at all times during each revolution. For example, at A, representing the top dead center condition of the piston in cylinder 16, pressurized gas is applied to the outer end of the cylinder 18 and to the inner end of the cylinder 17, thus concurrently driving the pistons of both cylinders to create a torque to drive the flywheel 15 in a clockwise direction. Concurrently, gas is being exhausted from the inner end of the cylinder 18 and from the outer end of the cylinder 17. At B, representing the bottom dead center condition of the piston in the cylinder 18, which condition is also shown in FIG. 1, pressurized gas is concurrently applied to the outer end of cylinder 16 and to the inner end of cylinder 17 while the inner end of the cylinder 16 and the outer end of cylinder 17 are being exhausted.

It will be noted that, unlike a conventional engine having a crankshaft and pivoted connecting rods intermediate the pistons and the cranks of the crankshaft and wherein a harmonic drive is applied in which torque is gradually increased from zero at the dead center of the piston to a maximum at midstroke, a constant torque is applied through the eccentric cam way 30 to the drive shaft 13, resulting in a continuous and uniform transfer of torque throughout each revolution of the drive shaft, even at slow speeds. Further, the torque is substantially the same regardless of the speed at which the engine is driven, this being particularly true at extremely slow speeds.

Obviously, there is no dead center position of the engine and it may be started under load in any position, thus obviating the need of a clutch mechanism between the engine and the load.

FIG. 7 illustrates schematically a preferred closed drive system for powering the engine. The various intake conduits, i.e. 42, 43, for the different valve mechanisma 34 are connected together and to a common conduit 70. Likewise, the various exhaust conduits, i.e. 48 and 50, are connected together to a common conduit 72.

Perhalogenated benzene is preferably used to generate a pressurized vapor for actuating the engine. It is substantially liquid form, the fluid is passed through a gas generator 71 where it is heated and converted to a gas under pressure. The gas is transferred through the conduit line 70 to the various intake sections of the valve chambers, i.e. 37 and 38, for the different cylinders 16 to 18. On the other hand, the gas exhausted from the various cylinders is passed through exhaust conduit 72 and a check valve 73. Part of the exhaust gas is transferred to an accumulator 75 and the remainder is passed through a valve 76 into a condenser 77 where it is cooled to return it to substantially liquid state and it is then passed through an expansion valve 78, and into the gas generator to complete the above cycle.

A heat source 80, preferably in the form of a burner, receives a combustible fuel from a suitable source (not shown) through an intake valve 81 for vaporizing the fluid within the generator 71.

Considering the system as incorporated in a motor vehicle, foot control pedal 82 is provided in conjunction with a conventional brake system and brake pedal (not shown). Pedal 82 is pivotally supported at 33 midway between its ends and is normally held in its neutral illustrated position by a spring 84. Pedal 82 is connected through linkage 85 to the valve 76 and through a second linkge 86 to the fuel control valve 81. Normally, when the pedal is in its illustrated neutral position, the valve 76 is open and valve 81 is closed. However, when the pedal is depressed clockwise to initiate operation of the engine, the valve 76 remains open and valve 81 is opened by an amount proportional to the amount of depression of the pedal to cause heating of the generator 71 to vaporize the fluid therein. When it is desired to brake the vehicle, the pedal 82 is depressed in a counterclockwise direction, causing actuating linkages 85 and 86 to close the valves 76 and 81, respectively, thus enabling the momentum of the vehicle to drive the engine. The engine now acts as a pump forcing the exhausted gases to pressurize the accumulator 75. The increase in pressure in the exhaust line 72 by virtue of the now closed valve 76 reacts against the pistons in the cylinders to bring about a braking action of the vehicle. Subsequently, in order to gain propel the vehicle, the pedal 82 is again rocked clockwise, releasing the pressurized gas in the accumulator to pass through the condensor 77 and generator 71 to accelerate the vehicle either independently of the expansive action of the fluid in generator 71 or conjointly therewith.

Although the engine is disclosed as embodying three cylinders, it will be obvious that a greater or a lesser number of cylinders could be incorporated.

It will be obvious to those skilled in the art that variations may be made in the exact construction shown without departing from the spirit and scope of the invention. For example, the engine may be operated as a pump by applying motive power to the drive shaft. Also, although the engine is disclosed as most advantageously forming an external combustion engine, it could be modified to operate as an internal combustion engine, in which case an ignition system, spark plugs and appropriately times intake and exhaust valves, all well known in the art, could be incorporated with the cylinders, i.e. 16, 17 and 18, to cause exploding gases to drive the engine. Accordingly, the term "fluid under pressure" in the appended claims is intended to define both fluids which are pressurized exteriorly of the cylinders and fluids which are pressurized as the result of explosions within the cylinders.

As will be evident to those skilled in the art from the foregoing disclosure and accompanying drawings, my illustrated engine is versatile as to the direction of rotation of shaft 13. More specifically, it is capable of turning the shaft in either direction of rotation so as, for example, to cause forward or reverse movement of a vehicle on which it is to be mounted for use.

I claim:

1. An engine comprising:

a rotatable member;

means for supporting said member for rotation about an axis;

a cylinder extending outwardly from said axis;

a piston element reciprocal in said cylinder;

said member having a cam groove therein extending about said axis;

roller means movable by said piston element;

said roller means engaging in said groove;

a second cylinder extending outwardly from said axis;

a second piston element reciprocal in said second cylinder;

second roller means movable by said second piston element;

said second roller means engaging in said groove;

a third cylinder extending outwardly from said axis;

a third piston element reciprocal in said third cylinder;

third roller means movable by said third piston element;

said cylinders extending equiangularly about said axis;

fluid applying means for applying fluid under pressure to each of said cylinders whereby to move the piston element therein and cause said roller means movable by that piston element to rotate said member;

said fluid applying means comprising means for applying said fluid concurrently to a majority of said cylinders throughout each revolution of said member;

said fluid applying means further comprising means forming fluid intake ports communicating with the inner and outer ends of each of said cylinders;

means forming fluid exhaust ports communicating with said inner and outer ends of each of said cylinder;

a first valve element for each of said cylinders comprising a first slide valve slidable to cover one of said respective intake ports and uncover the other of said respective intake ports;

a second valve element for each of said cylinders comprising a second slide valve slidable to cover one of said respective exhaust ports and uncover the other of said exhaust ports;

a drive gear;

means operable by said member for rocking said drive gear;

means on one of said slide valve elements forming a rack gear meshing with said drive gear on one side of said drive gear; and means on the other of said slide valve elements forming a second rack gear meshing with said drive gear on the opposite side of said drive gear whereby rocking of said drive gear causes movement of said slide valves in opposite directions.

* * * * *

UNITED STATES PATENT AND TRADEMARK OFFICE

CERTIFICATE OF CORRECTION

PATENT NO. : 4,632,017

DATED : December 30, 1986

INVENTOR(S) : WILLIAM S. BOKON

It is certified that error appears in the above-identified patent and that said Letters Patent is hereby corrected as shown below:

On the title page containing the Abstract, after "[63]", "419,349" under "Related U.S. Application Data" should be --415,349--.

Column 4, line 22 "rach" should be --rack--; line 26, "FIGS." should be --FIG.--; line 53, change "powr" to --power--; and line 68, cancel "the", third instance. Column 5, line 28, "It is" should read --In its--. Column 6, line 2, "gain" should read --again--; and line 20, "times" should read --timed--.

Signed and Sealed this

Second Day of May, 1989

*Attest:*

DONALD J. QUIGG

*Attesting Officer*

*Commissioner of Patents and Trademarks*